United States Patent [19]

Mack et al.

[11] Patent Number: 4,464,907

[45] Date of Patent: Aug. 14, 1984

[54] PROCESS FOR THE OPERATION OF AN ABSORPTION HEAT PUMP CAPABLE OF BIVALENT OPERATION AND ABSORPTION HEAT PUMP FOR IMPLEMENTING THIS PROCESS

[75] Inventors: Robert Mack, Heilbronn; Winfried Buschulte, Neckarsulm, both of Fed. Rep. of Germany

[73] Assignee: Deutsche Forschungs- und Versuchsanstalt für Luft- und Raumfahrt e.V., Fed. Rep. of Germany

[21] Appl. No.: 500,269

[22] Filed: Jun. 2, 1983

[30] Foreign Application Priority Data

Jun. 11, 1982 [DE] Fed. Rep. of Germany ..... 32220677

[51] Int. Cl.[3] ..... F25B 15/00

[52] U.S. Cl. ..... 62/101; 62/238.3; 62/476; 62/489; 62/495

[58] Field of Search ..... 62/476, 489, 238.3, 62/101, 495

[56] References Cited

U.S. PATENT DOCUMENTS 3,638,452 2/1972 Kruggel ..... 62/495 X 3,817,050 6/1974 Alexander et al. ..... 62/476 X

*Primary Examiner*—Lloyd L. King

*Attorney, Agent, or Firm*—Kenway & Jenney

[57] ABSTRACT

In an absorption heat pump capable of bivalent operation, to make possible a combined operation in addition to the pure heat pump operation and the pure boiler operation, it is proposed to divide the refrigerant stream after the condenser and the stream of weak solution leaving the boiler, with one component stream of the refrigerant being fed through the refrigerant throttle and the vaporizer to a low-pressure absorber, into which a component stream of the weak solution is introduced through the temperature changer and the solvent throttle, while the other component stream of the refrigerant is fed either directly to the boiler or to a high-pressure absorber, to which the other component stream of the weak solution is fed directly in both cases, and to feed the strong solution from the low-pressure absorber through the temperature changer and/or the reflux condenser to the boiler, but on the other hand to feed the solution from the high-pressure absorber directly to the boiler.

12 Claims, 2 Drawing Figures

Figure 1:
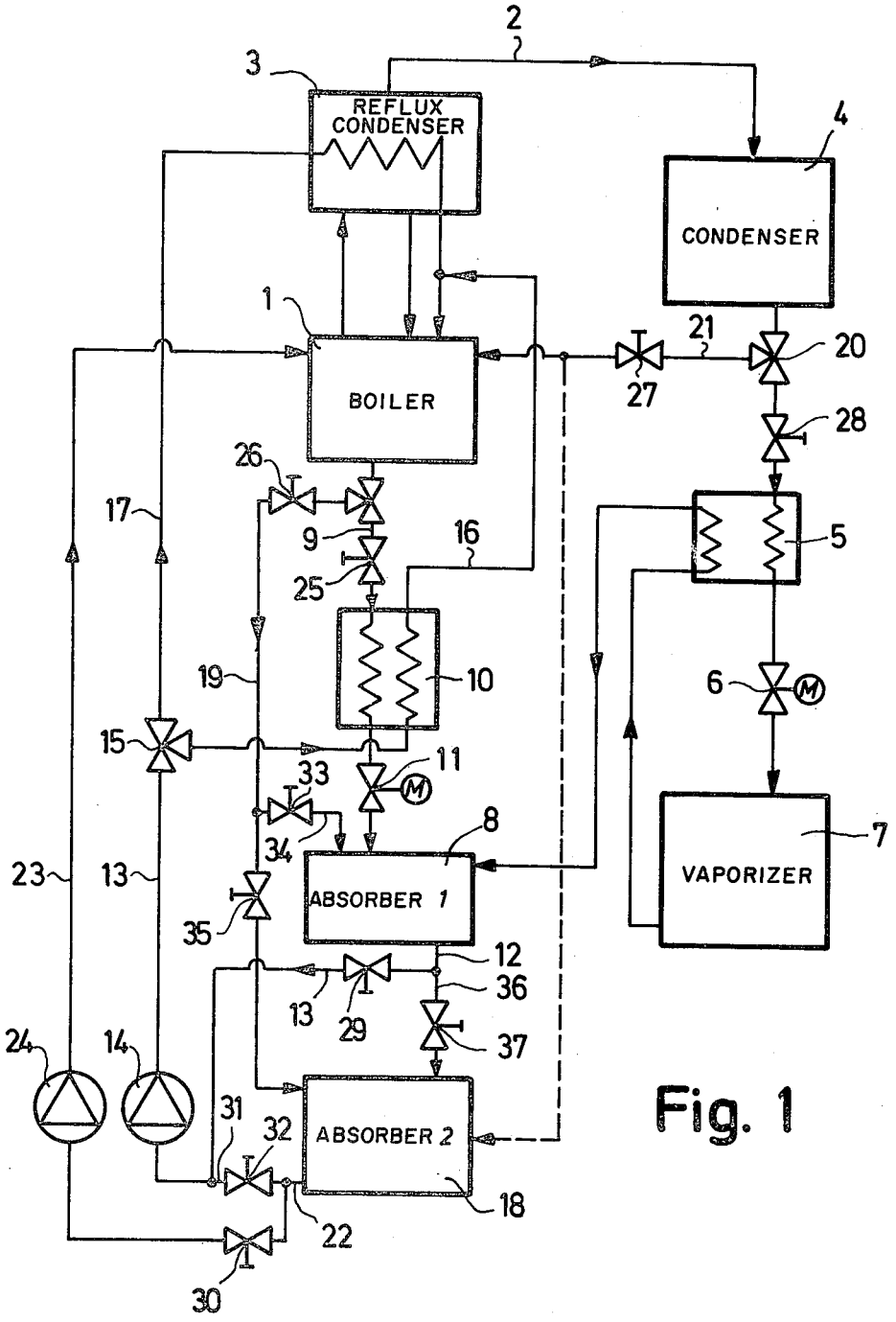

PROCESS FOR THE OPERATION OF AN ABSORPTION HEAT PUMP CAPABLE OF BIVALENT OPERATION AND ABSORPTION HEAT PUMP FOR IMPLEMENTING THIS PROCESS

This invention concerns a process for the operation of an absorption pump capable of bivalent operation, as described in the descriptive section of claim 1.

The invention also concerns a bivalent absorption pump for implementing this process, with the features of the descriptive section of claim 6.

Absorption heat pumps can be used effectively for heating purposes only when the air temperature does not fall below a specific figure, such as +3° C., for example. At lower temperatures, the performance factor falls sharply, particularly because of the icing of the vaporizer.

It is already known how to reverse the absorption heat pump under these unfavorable operating conditions so that it can be operated in pure boiler operation, i.e., the heat introduced to the boiler from a heat source is supplied directly to a heat exchange surface by which the heating medium is heated (German patent application disclosure Nos. 2,856,767 and 2,758,773).

These known absorption heat pumps can be operated only either in pure heat pump operation or in pure boiler operation, with the reversal from one mode of operation to the other being associated with a substantial regulating and control effort and requiring a considerable time. In pure boiler operation, an incomplete utilization of the primary energy occurs overall, which can be attributed to the losses in the circulation system. Finally, with this operation, a changeover from the pure heat pump operation to the pure boiler operation must be made even at a temperature at which heat could definitely still be withdrawn from the surroundings through the vaporizer, although not to a completely adequate extent for a pure heat pump operation. If the changeover to the pure boiler operation is already made at this temperature in the known systems, the supply of the heat still available as such at the vaporizer must be completely relinquished.

It is the purpose of this invention to improve a process for the operation of an absorption heat pump in such a way that a combined operation is possible in addition to a pure heat pump operation and a pure boiler operation.

This problem is solved pursuant to the invention in a process of the type described initially, by the features specified in the characterizing section of claim 1.

For the implementation of this process pursuant to the invention, an absorption heat pump with the features of claim 6 is proposed.

Therefore, in accordance with the invention, for a combined operation, both the solvent stream from the boiler to the absorber and the refrigerant stream leaving the vaporizer are split into two component streams. One component stream of the solvent and one component stream of the refrigerant are treated in the manner typical of the pure heat pump operation, while the other component stream of each is treated in the manner typical of pure boiler operation. To make this possible, the absorber is divided into a low-pressure absorber used for the pure heat pump operation and a high-pressure absorber used for the pure boiler operation.

The heat exchange with the heating system occurs in the condenser and in both absorbers. In this way, it is possible to make use of the advantages of both the pure heat pump operation and of the pure boiler operation jointly, with the capability of infinitely adjusting the proportion of the pure heat pump operation relative to the proportion of the pure boiler operation in accordance with the ratio of the splitting of the two streams into component streams.

It is beneficial in the combined operation to increase the throttling action of the two throttles in comparison with the pure heat pump operation, so that the throttling action can be matched to the lower flow rate of the heat pump circulation.

It is also beneficial in the combined operation to conduct the component stream of refrigerant only through a section of the vaporizer.

In the combined operation, the gas flow cross section of the vaporizer is preferably reduced in comparison with the pure heat pump operation. Because of the smaller active area of the vaporizer, it is possible to keep it ice-free and effective for a longer time, so that the heat pump operation can be maintained down to lower temperatures.

It can be provided in pure heat pump operation for the weak solution and the refrigerant to be combined in the low-pressure absorber and for the strong solution formed then to be conducted through the high-pressure absorber. In this case, both of the absorbers are used for heat exchange even in pure heat pump operation.

To make the throttle valves in the refrigerant line and in the solvent line adjustable in their throttling action, they can be designed as variable flow volume expansion valves. In a modified example of embodiment, it can be provided for the throttles to comprise at least two parallel lines with throttle valves, with the parallel lines being able to be opened jointly or alternately by means of on-off valves. By suitable choice of the throttling power in the individual parallel lines, the throttling action of either line can be utilized alone, or the throttling action of the lines connected in parallel can be utilized jointly.

In a beneficial refinement of the invention, it is provided that the high-pressure absorber in pure heat pump operation can be inserted between the low-pressure absorber and the first return line.

Figure 2:
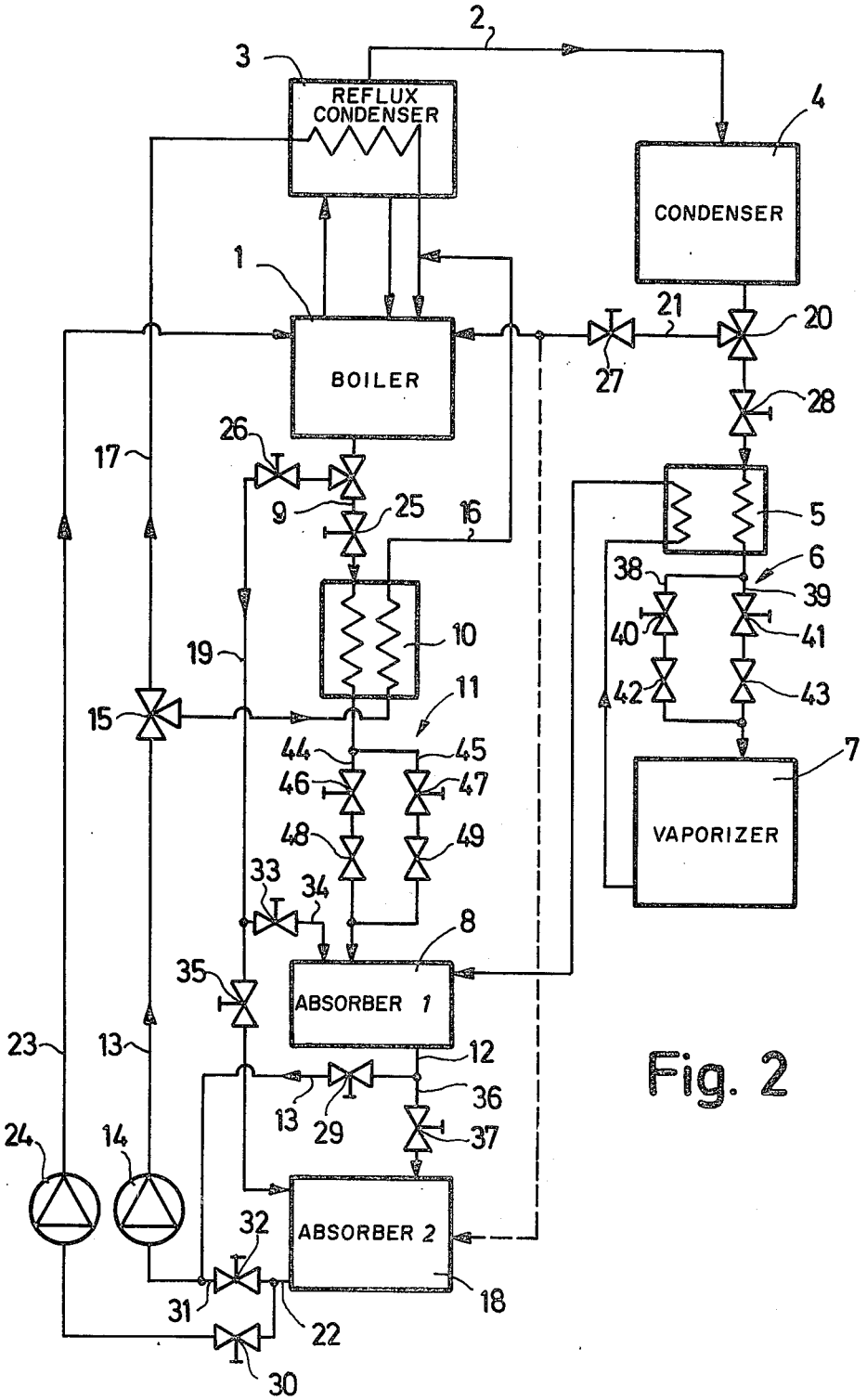

The following description of preferred forms of embodiment of the invention combined with the drawing serves for a detailed explanation. The drawings show:

FIG. 1: a schematic illustration of an absorption pump for the implementation of the process pursuant to the invention, and FIG. 2: a view similar to FIG. 1 with a different design of the refrigerant throttle and of the solvent throttle.

In the traditional manner for heat pumps, the heat pump illustrated in the drawing comprises a boiler or expeller 1, in which a refrigerant-solvent mixture is heated by means of a source of heat not shown in the drawing. The refrigerant then vaporized is fed by a refrigerant line 2 through a reflux condenser 3 to a condenser 4, and from here it is fed in the liquid state through a heat exchanger 5 and a refrigerant throttle 6 to a vaporizer 7. The revaporized refrigerant, which is then at low pressure, is fed in countercurrent through the heat exchanger 5 to a first absorber 8, which is called the low-pressure absorber hereinbelow.

From the boiler 1, a solvent line 9 leads through a temperature changer 10, and through a solvent throttle 11 also to the first absorber 8, in which the refrigerant fed through the refrigerant line 2 and the solvent fed through the solvent line 9 are combined.

From the outlet 12 of the first absorber 8, a first return line 13, in which there is a circulating pump 14, leads to a branch 15. From this branch, a first line 16 leads in countercurrent through the temperature changer 10 to the boiler 1, while a second line 17 leads through the reflux condenser 3 to the boiler 1.

The components of the absorption heat pump described up to now correspond to the usual construction with branched return of the strong solution. Pursuant to the invention, in addition to the low-pressure absorber 8, there is a second absorber 18 which is called the high-pressure absorber hereinbelow. A bypass line 19 feeds the solution from the boiler 1 directly to this high-pressure absorber 18, circumventing the temperature changer 10 and the solvent throttle 11.

A branch 20 is provided in the refrigerant line 2, downstream from the condenser; at this point, a bypass line 21 branches away from the refrigerant line 2, and leads either directly to the boiler or preferably, in accordance with the broken line in the illustration, to the high-pressure absorber 18. A second return line 23, in which there is a second circulating pump 24, is connected to the outlet 22 of the high-pressure absorber 18. The second return line 23 feeds directly into the boiler 1.

A metering valve 25 which can be completely closed is located in the solvent line 9, and likewise a metering valve 26 which can be completely closed is positioned in the bypass line 19. Another metering valve 27 which can be completely closed is inserted in the bypass line 21. Another metering valve 28 which can be completely closed is positioned in the refrigerant line downstream from the branch 20.

Shutoff valves 29 and 30 are positioned in the return lines 13 and 23, respectively, and the outlet 22 of the absorber 18 is connected downstream of the shutoff valve 29 by means of a connecting line 31, in which there is a shutoff valve 32.

A diversion line to the first absorber 8, provided with a shutoff valve 13, branches away from the bypass line 19; another shutoff valve 35 is placed in the bypass line downstream from this branch.

Another connecting line 36, in which there is a shutoff valve 37, joins the outlet 12 of the first absorber 8 with the inlet of the second absorber 18.

The two throttles 6 and 11 are adjustable in their throttling action, as indicated in the drawing by a motorized actuator. These throttles can also be designed as variable flow rate expansion valves.

Another possible refinement of the throttles is shown in the example of embodiment of FIG. 2, which differs from the example of embodiment of FIG. 1 only in the design of the throttles. Corresponding components therefore show the same reference symbols.

The refrigerant throttle 6 in the example of embodiment of FIG. 2 comprises two parallel lines 38 and 39. There is a shutoff valve 40 or 41 connected in series with a throttling valve 42 or 43, respectively, with fixed throttling action in each of these lines.

In the same way, the solvent throttle 11 comprises two parallel lines 44 and 45, each of which includes a shutoff valve 46 or 47 and a throttle valve 48 or 49, respectively, with fixed throttling action.

The heat pump illustrated in the drawing can be operated in three different ways, described below.

In pure heat pump operation, the valves 26, 27, 30, 32, 33, 35, and 37 are closed, while only the valves 25, 28, and 29 are opened. In this operation, the refrigerant vaporized by the boiler is fed through the refrigerant line 2, through the condenser, the refrigerant throttle, and the vaporizer, to the low-pressure absorber 8. The weak solution from the boiler passes through the solvent line 9, the temperature changer, and the solvent throttle 11, likewise into the low-pressure absorber. After the combining of the two components, the strong solution is fed through the first return line 13 and the two lines 16 and 17, back to the boiler again.

In the pipe circuit described, the strong solution passes only through the low-pressure absorber 8; the high-pressure absorber 18 is not connected into the circuit in this mode of operation.

In an alternative method of pure heat pump operation, the valve 29 is closed, while the valves 32 and 37 are opened. The strong solution then also flows through the high-pressure absorber 18 before entering the first return line 13, so that heat exchange with the heating system can occur also in this high-pressure absorber.

In pure boiler operation, the valves 25, 28, 29, 32, 33, and 37 are closed, while the valves 26, 27, 30, and 35 are opened. In this case, the refrigerant leaving the boiler then passes through the bypass line 21 either directly into the boiler or into the high-pressure absorber 18. The refrigerant throttle and the vaporizer are then bypassed because of the closed valve 28.

The solvent passes through the bypass line 19 directly into the high-pressure absorber 18, with the temperature changer 10 and the solvent throttle 11 being bypassed. The heat exchange with the heating system occurs in the high-pressure absorber, and the cooled solvent, to which the similarly cooled refrigerant is optionally added, thereupon reaches the boiler through the second return line 23. Since both the refrigerant throttle and the solvent throttle are bypassed, the same pressure prevails in the entire circuit as in the boiler, which is a relatively high pressure. The pump 24 is therefore designed as a pure circulating pump, while the pump 14 is designed as a pressure pump which must operate against the pressure in the boiler, in the manner customary with absorption heat pumps.

In the combined operation pursuant to the invention, in which both a heat pump action and a boiler action are produced, only the valves 32, 33, and 37 are closed, while the other valves 25, 26, 27, 28, 29, 30, and 35, on the other hand, are opened. Because of this, both the refrigerant stream and the solvent stream are split. A portion of the refrigerant stream passes through the refrigerant line, the refrigerant throttle 6, and the vaporizer 7, to the low-pressure absorber, while the other portion of the refrigerant is fed through the bypass line 21 either to the boiler 1 or to the high-pressure absorber 18.

A portion of the solvent passes through the solvent line 9, the temperature changer 10, and the solvent throttle 11, to the low-pressure absorber 8, while the other component stream flows through the bypass line 19 directly to the high-pressure absorber 8. The weak solution leaving the low-pressure absorber is fed through the first return line 13 from the pump 14 back to the boiler, while the solution leaving the high-pressure absorber 18, to which the refrigerant is optionally added, is passed by means of the circulating pump 24 through the second return line 23 back into the boiler 1.

Heat exchange with the heating system occurs in the condenser as well as in both absorbers. Heat originating from the heater of the boiler is thereby introduced directly to the heating system in the condenser and in the high-pressure absorber, while heat taken from the surroundings by the vaporizer is supplied to the heater in the low-pressure absorber.

The ratio of the two refrigerant component streams to one another and the ratio of the two solvent component streams to one another can be infinitely adjusted from pure heat pump operation to pure boiler operation by suitable selection of the opening of the valves 27 and 28, or 25 and 26, which are correlated with one another. The throttling action of the refrigerant throttle 6 and of the solvent throttle 11 can then be changed according to the size of the component stream flowing through the throttles, so that the depressurization necessary for the heat pump action occurs.

This can take place differently in the manner mentioned above, depending on the design of the throttles; in the example of embodiment of FIG. 2 this throttling is achieved by appropriate opening or closing of the shutoff valves 40 and 41 or 46 and 47.

In order to be able to control the heat pump described continuously between the pure heat pump operation and the pure boiler operation, it is sufficient to modify the opening condition of the valves 25 and 26 or 27 and 28 continuously, and to open or close the valves 29, 30, and 35. The throttling action of the throttles 6 and 11 must also be matched appropriately to the state of opening of the valves 25, 26, 27, and 28. No other changes are necessary.

Since the change can occur continuously between the two extreme operating states, the entire system can be matched optimally to the external circumstances, and in particular it is possible at any time during the combined operation to choose a larger proportion of heat pump operation and a smaller proportion of boiler operation, or the reverse, depending on the requirements.

In pure boiler operation, it would also be possible to pass the solvent also through the low-pressure absorber 8 in order to permit heat exchange with the heating system here also. In this case, the valve 35 is closed, while the valves 33 and 37 are opened.

In pure boiler operation, the flow rate of both the refrigerant driven out of the boiler and of the weak solution flowing from the boiler to the absorber is controlled not by regulating valves with controllable throttling action, in the known manner, but by a different pump delivery of the circulating pump or of the circulating pumps in the return lines 13 and 23. For this purpose, these pumps can beneficially be of multistage or variable flow rate design. It turns out to be of significant advantage here that no pressure drop caused by adjustable throttle valves occurs in the line, but the pressure level is approximately the same in the entire pipe system. Only low pump deliveries are therefore needed for circulating the solution, which overall are significantly lower than those which have had to be supplied in conventional processes in which the flow rate has been produced by variable throttling of the streams.

By these measures, complicated regulating valves which might give rise to problems can also be avoided. The circulating pumps can be controlled most simply, and can therefore be adapted optimally to the particular requirements.

We claim:

1. Process for the operation of an absorption heat pump capable of bivalent operation, in which in pure heat pump operation the refrigerant driven out in the boiler is fed through a condenser, a refrigerant throttle, and a vaporizer to an absorber, where it is combined with a weak solution fed from the boiler to the absorber through a temperature changer and a solvent throttle, and the strong solution formed is fed through the temperature changer, and optionally through a reflux condenser used to cool the refrigerant stream leaving the boiler, to the boiler, while in pure boiler operation, the refrigerant driven out of the boiler is fed after the condenser directly to the absorber, while the weak solution from the boiler is fed directly to the absorber and the strong solution leaving the absorber is fed directly to the boiler, characterized by the fact that in combined operation, the refrigerant stream is divided after the condenser, and the stream of weak solution leaving the boiler is divided, with one component stream of the refrigerant being fed through the refrigerant throttle and the condenser to a low-pressure absorber, into which one component stream of the weak solution is introduced through the temperature changer and the solvent throttle, while the other component stream of the refrigerant is fed either directly to the boiler or to a high-pressure absorber, to which the other component stream of the weak solution is fed directly in both cases, and that the strong solution from the low-pressure absorber is fed to the boiler through the temperature changer and/or the reflux condenser, while on the other hand, the solution from the high-pressure absorber is fed directly to the boiler.

2. Process pursuant to claim 1, characterized by the fact that in combined operation, the throttling action of the two throttles is increased in comparison with the pure heat pump operation.

3. Process pursuant to claim 1, characterized by the fact that in combined operation, the component stream of refrigerant is passed only through one section of the vaporizer.

4. Process pursuant to claim 1, characterized by the fact that in combined operation, the gas flow cross section of the vaporizer is reduced in comparison with pure heat pump operation.

5. Process pursuant to claim 1, characterized by the fact that in pure heat pump operation, the weak solution and the refrigerant are combined in the low-pressure absorber, and the strong solution formed then passes through the high-pressure absorber.

6. Process pursuant to claim 1, characterized by the fact that in pure boiler operation, the flow rate of the refrigerant driven out of the boiler and the flow rate of the weak solution flowing out of the boiler to the absorber are not regulated with throttle valves, but are controlled by variable pump delivery of the circulating pump or circulating pumps transporting the strong solution leaving the absorber.

7. Bivalent absorption heat pump with a refrigerant line leading from a boiler to an absorber, in which are inserted successively a condenser, a refrigerant throttle, and a vaporizer, with a solvent line feeding a weak solution from the boiler to the absorber through a temperature changer and a solvent throttle, with a return line feeding the strong solution from the absorber to the boiler through the temperature changer and/or a reflux condenser used to cool the refrigerant driven out of the boiler, in which there is a circulating pump, with a bypass line which can be closed, with which the refrigerant can be fed from the output of the condenser directly to the boiler or to the absorber while circumventing the refrigerant throttle and the vaporizer, with another bypass line which can be shut off, with which the weak solution can be fed directly to the absorber while circumventing the temperature changer and the solvent throttle, characterized by the fact that the absorber is divided into a low-pressure absorber (8) and a high-pressure absorber (18), that the refrigerant line (2) coming from the vaporizer (7) leads to the low-pressure absorber (8) and the bypass line (21) leads to the boiler (1) or to the high-pressure absorber (18), that the solvent line (9) leads to the low-pressure absorber (8), while the bypass line (19), on the other hand, leads to the high-pressure absorber (18), that a second return line (23) leading directly to the boiler (1) and having a second circulating pump (24) is provided, which can be connected to the outlet (22) of the high-pressure absorber (18), while the first return line (13) can be connected to the low-pressure absorber (8), and that on-off valves (25, 26, 27, 28, 30, 32) are placed in the refrigerant line (2) after the branch (20) of the bypass line (21), in the bypass line (21), in the solvent line (9) after the branch of the bypass line (19), in the bypass line (19), and in both return lines (13 and 23).

8. Heat pump pursuant to claim 7, characterized by the fact that the throttles (6, 11) in the refrigerant line (2) and in the solvent line (9) are adjustable in their throttling action.

9. Heat pump pursuant to claim 8, characterized by the fact that the throttles (6, 11) are variable flow rate expansion valves.

10. Heat pump pursuant to claim 8, characterized by the fact that the throttles (6, 11) comprise at least two parallel lines (38, 39; 44, 45) with throttle valves (42, 43; 48, 49), and the parallel lines (38, 39; 44, 45) can be opened jointly or alternately by on-off valves (40, 41; 46, 47).

11. Heat pump pursuant to claim 7, characterized by the fact that the high-pressure absorber (18) in pure heat pump operation can be switched in between the low-pressure absorber (8) and the first return line (13).

12. Heat pump pursuant to claim 7, characterized by the fact that the circulating pumps (14, 24) have multistage or variable flow rate design.

* * * * *